United States Patent [19]

Lalama et al.

[11] Patent Number: 4,979,574

[45] Date of Patent: Dec. 25, 1990

[54] PUNCH TOOL APPARATUS AND METHOD

[76] Inventors: Craig R. Lalama, 183 Crankbrooke Dr., Coraopolis, Pa. 15108; Carl W. Medsger, R.D. #1, Box 240A, West Newton, Pa. 15089

[21] Appl. No.: 781,686

[22] Filed: Sep. 30, 1985

[51] Int. Cl.[5] ..... B25D 17/00; B21D 20/00

[52] U.S. Cl. ..... 173/1; 173/94; 173/132; 29/254; 81/463; 81/177.8

[58] Field of Search ..... 30/358, 367; 173/94, 173/93, 96, 128, 129, 132; 81/3.34, 3.35, 3.48, 463, 177.8; 144/193 R, 193 C; 125/40–43; 29/254, 255

[56] References Cited

U.S. PATENT DOCUMENTS

| | | | |
|---|---|---|---|
| 951,890 | 3/1910 | Tremblay | 30/367 X |
| 2,301,889 | 11/1942 | Lear | 173/93 |
| 2,475,041 | 7/1949 | Mattson | 30/367 X |
| 2,655,825 | 10/1953 | Gendron | 173/93 |
| 3,550,486 | 12/1970 | Edwards | 81/177.8 |
| 3,791,012 | 2/1974 | Jenkin | 81/463 |
| 4,327,806 | 5/1982 | Arya | 173/132 |

*Primary Examiner*—Frank T. Yost
*Assistant Examiner*—Scott A. Smith
*Attorney, Agent, or Firm*—Lawrence G. Zurawsky; Thomas F. Shanahan

[57] ABSTRACT

A punch tool for applying force to a work piece includes a body, a grip mounted on one end of the body, a punch connected to the other end of the body, and an anvil pivotally connected to the body between the grip and the punch. A method for disengaging a fastener from an object in a limited work space includes inserting the punch of the tool into the work space in engagement with the fastener and striking the anvil with force sufficient to disengage the fastener. A method for punching a hole in an object at a point within a limited work space includes inserting the punch portion of the tool into the work space in engagement with the point and striking the anvil with force sufficient to punch a hole in the object.

7 Claims, 1 Drawing Sheet

PUNCH TOOL APPARATUS AND METHOD

BACKGROUND OF THE INVENTION

1. Field of the Invention

This invention relates to a punch tool apparatus and a method for disengaging a fastener from an object in a limited work space and for punching a hole through an object in a limited work space.

2. Description of the Prior Art

The prior art discloses several types of hand tools, including punches, taps and pin sets, that can be set at an angle to the tool handle to facilitate more convenient, or more effective, operation of the tool. However, such devices do not permit use of the tool in situations in which the available work space is relatively limited and restricted or in which the work piece is relatively inaccessible. In addition, such devices do not provide a punch tool that can be used on a relatively inaccessible work piece in a limited or restricted work space while permitting the application of the forceful blows to actuate the punch tool.

U.S Pat. No. 2,656,865 discloses a ratchet tool with an adjustable handle that can be set at a 90° angle with the working end of the tool, which can be a screw driver, a socket head, an awl, a gimlet, a nail set or a socket. That patent does not disclose a punch tool for use in restricted, relatively inaccessible spaces and to which forceful blows can be applied to actuate the tool.

U.S. Pat. No. 2,712,765 discloses a wrist-motion rotary hand tool in which the handle can be set at various angles to the working member, which can consist of a screwdriver, a drill bit, a tap or a reamer. That patent does not disclose a punch tool, useful in a restricted or relatively inaccessible space, to which forceful blows can be applied to actuate the tool.

U.S. Pat. No. 1,177,604 and Australian Pat. No. 487,053 disclose screwdrivers with adjustable handles to improve the torque that might be applied to the working member of the tool. Neither of those patents discloses a punch tool suitable for use in restricted or relatively inaccessible spaces which can be actuated to forceful blows to the tool.

U.S. Pat. No. 2,921,773 discloses a pry bar on which the pry point can be angularly adjusted with respect to the handle. That patent does not disclose a punch tool, useful in a restricted or relatively inaccessible space, to which the forceful blows to actuate the tool can be applied to a separate anvil member which is adjustable in its angular relation to the body of the tool.

U.S. Pat. No. 174,136 discloses a graver holder having a circular mounting head containing a number of seating recesses into which a graver can be inserted at a preselected angle with respect to the body and handle of the tool. That patent does not disclose a punch tool suitable for use in restricted or relatively inaccessible work spaces which can be actuated by forceful blows to a separate anvil mounted at an adjustable angle on the body of the tool.

U.S. Pat. No. 2,608,894 describes a wrench having a work-engaging head that is adjustable to a preselected angle to the wrench handle and which can be easily removed from the wrench handle for substitution of a head of another size. That patent does not disclose a punch tool, useful in a restricted or relatively inaccessible work space, to which forceful blows to actuate the tool can be applied to a separate anvil connected to the tool body in adjustable angular relation.

U.S. Pat. No. 3,924,327 discloses apparatus for cutting the bottom rubber seal and the edge rubber seal of vehicle windshield tracks for the replacement of a windshield. That apparatus includes a frame having a handle at one end and cutting blades mounted on the other end of the frame. A "chisel", or force transfer ing member is attached at one end to an air hammer and has a fork shaped member at the other end of the chisel for loose engagement of the frame to transfer force from the air hammer to the frame. Use of that device requires substantial yet easy control of the tool to prevent movement of the cutting blade away from the relatively narrow tracks and the rubber seal, which prevents damage to the tool, or to the vehicle, or both. Such substantial control is achieved by disposing the chisel in a plane generally perpendicular to the handle of the frame and by connecting a collar to the frame to support the chisel and prevent movement of the chisel along the frame toward the cutting blades. That patent does not disclose a punch tool for use in a relatively inaccessible and restricted work space and having an angularly adjustable anvil member rigidly connected to the tool body.

There remains a need for a punch tool for use in relatively inaccessible or relatively restricted work spaces having an anvil member that is rigidly connected to the tool body and which is adjustable in its angular relation to the tool body to permit effective application of the required tool actuating force at a location outside of, or remote from, the restricted or inaccessible work space.

SUMMARY OF THE INVENTION

In accordance with the present invention, there is provided a punch tool apparatus that includes a body having two opposite end portions, grip means mounted on one end portion of the body, a punch member connected to the other end portion of the body, and an anvil member connected to the body between the grip means and the punch member. In a preferred embodiment of the apparatus of this invention, the anvil member pivotally mounted on the body.

In further accordance with the present invention, there is provided a method for disengaging a fastener from an object containing the fastener in a limited work space whereby there is inserted into the work space the punch member of a tool having a body, grip means connected to one end of the body, a punch connected to the other end of the body in angular relation to the body, and an anvil member connected to the body between the punch and the grip means. The punch is positioned in aligned engagement with the fastener and the anvil member is struck with force sufficient to disengage the fastener from the object or, more specifically, to drive the fastener through the object.

Another embodiment of the present invention provides a method for punching a hole in an object at a point located within a limited work space whereby there is inserted into the work space the punch portion of a tool having a body, grip means connected to one end of the body, a punch connected to the other end of the body in angular relation to the body, and an anvil member connected to the body between the punch and the grip means. The punch is positioned in aligned engagement with the preselected point on the object and the anvil member is struck with force sufficient for the punch to pierce the object and punch a hole in the object at that point.

Accordingly, it is an object of the present invention to provide a punch tool apparatus for use in relatively restricted or relatively inaccessible work spaces.

It is a further object of the present invention to provide a punch tool apparatus suitable for use in relatively restricted or relatively inaccessible work spaces, which tool includes an anvil member rigidly connected to the tool body while being adjustable in its angular relation to the tool body and which can be positioned remote from the work space to receive force applied to actuate the tool.

It is another object of the present invention to provide a method for disengaging a fastener from an object containing the fastener in a relatively restricted or relatively inaccessible work space.

Still another object of the present invention is to provide a method for punching a hole in an object at a point located within a relatively restricted or relatively inaccessible work space.

Those and other objects of the present invention will be more completely disclosed and described in the following specification, the accompanying drawings and the appended claims.

DESCRIPTION OF THE PREFERRED EMBODIMENTS

Figure 1:
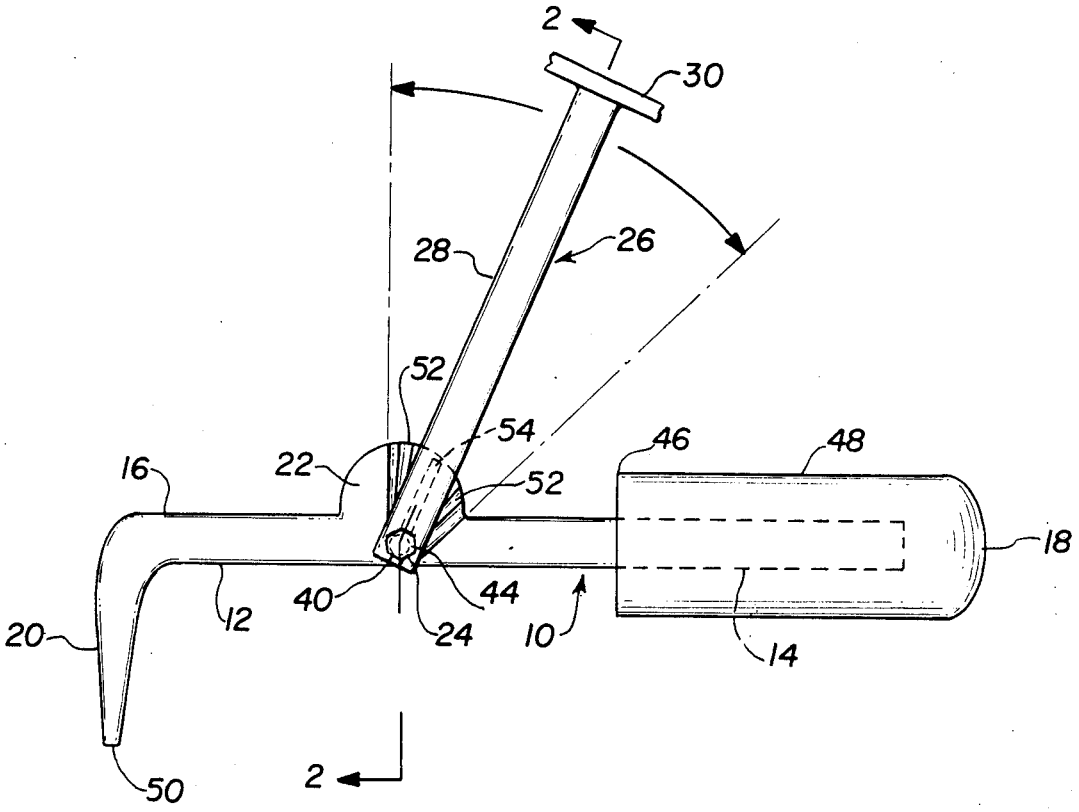
FIG. 1 is a side elevation view of a typical punch tool apparatus of this invention.

Referring to the drawings, and particularly to FIG. 1, an embodiment of the punch tool apparatus of this invention is indicated generally by reference numeral 10 and has a body 12 having one end portion 14 and an opposite end portion 16. A grip means 18 is secured to the end 14 of body 12. Grip means 18 can be any type of conventional or novel grip means or handle means suitable for use with hand tools.

A punch member 20 is connected to the end 16 of body 12, remote from grip means 18. Punch member 20 is shown as being of unitary construction with body 12; however, punch member 20 can be attached to body 12 by any suitable connecting means such as a socket connector. Punch member 20 is shown in FIG. 1 as disposed at an angle of 90° with respect to a central longitudinal axis through body 12; however, within the concept of this invention, punch member 20 can be connected to body 12 in co-axial alignment with body 12, or alternatively, can be connected to body 12 at some other angle with respect to body 12 other than 90°, depending upon the desired angle required by the work to be performed in a particular restricted or relatively inaccessible work space. It is further within the concept of this invention to substitute for punch member 20 any other working member suitable for use with a punch type hand tool, such as an awl, a gimlet, a nail member, a tap or a chisel. Any such working end member is suitable for use with the tool 10 as long as such working member is capable, with the application of force to the tool, of dislodging a fastener from an object containing the fastener, or is capable of forming a hole or aperture in the surface of a work piece or other object.

A boss 22 extends from body 12 at a location between grip means 18 and punch member 20. A hole 24 extends through the sides of body 12 below boss 22. An anvil member 26 consists of a shank 28 having a striking head 30 connected to one end of shank 28 remote from the body 12. The other end of shank 28 contiguous to body 12 consists of a pair of spaced, parallel side members 32 and 34 forming an anvil yoke 36. The configuration of the internal surface 38 of yoke 36 is constructed and arranged to conform to the shape or configuration of the surface of boss 22 contiguous to the inner surface 38 of yoke 36. Each of the side members 32 and 34 of yoke 36 has extending there through a hole 40 and 42, respectively, so arranged as to provide, in assembly, co-axial alignment of the holes 40 and 42 with the hole 24 through body 12. A bolt 44 is secured within holes 24, 40 and 42 and tightened at its threaded end by a nut 46 to provide means for securing anvil member 26 in rigid engagement with boss 22 and body 12 in assembly and to permit easy loosening of anvil member 26 with respect to boss 22 and body 12 to provide for selective repositioning of anvil member 26 on boss 22 and body 12 with respect to punch member 20.

Body 12, boss 22, anvil member 26 and their mutual connecting means are so constructed and arranged as to provide for the easy and rapid setting of the angular relationship between the central longitudinal axes of anvil member 26 and body 12 at a preselected angle within a wide range of angles. In some uses of the apparatus of this invention it is possible and desirable to set anvil member 26 at an angle of 90° with respect to the central longitudinal axis of body 12. That arrangement is most useful in transmitting maximum force to punch member 20 when punch member 20 depends at an angle of 90° from body 12 and when the available work space permits such a setting of anvil member 26.

Its other uses of the apparatus of this invention, the angular relation between punch member 20 and body 12, the available work space, the relative inaccessibility of the working area, or some combination of those circumstances require that anvil member 26 be set at some angle other than 90° with respect to the angular relationship between anvil member 26 and body 12. The lower limit of the preset angle between anvil member 26 and body 12 is determined by additional considerations. For example, anvil member 26 should not be set at an angle that permits contact between shank 28 and the corner 46 of grip means 18, or that permits contact between striking head 30 and the surface 48 of grip means 18. Setting anvil member 26 at 20 degrees prevents contact between any portion of anvil member 26 and any portion of grip means 18 and prevents damage to grip means 18 when force is applied to striking head 30. However, when punch member 20 is arranged co-axially, or nearly co-axially, with end portion 16 of body 12, or when the available work space or the accessibility of the work area requires, anvil member 26 can be set at a small angle with respect to the axis of body 12, as long as contact between anvil member 26 and grip means 18 is avoided.

Although boss 22 and yoke 36 of anvil member 26 can be located on body 12 midway between punch member 20 and grip means 18 in some embodiments of the apparatus of this invention, generally the location of boss 22 and anvil member 26 on body 12, and the length of end portion 16 of body 12 between anvil member 26 and punch member 20, are arranged to accommodate the available work space and the accessibility and location of the work area. Generally, it is desirable to provide that the working end 50 of punch member 20 can be aligned contiguous with the surface upon or toward which end 50 of punch member 20 must exert a working force while permitting relatively unrestricted access to striking head 30 of anvil member 26 either remote from the existing working space, or within the existing work space when sufficient force can be applied to striking head 30 in that setting.

Figure 2:
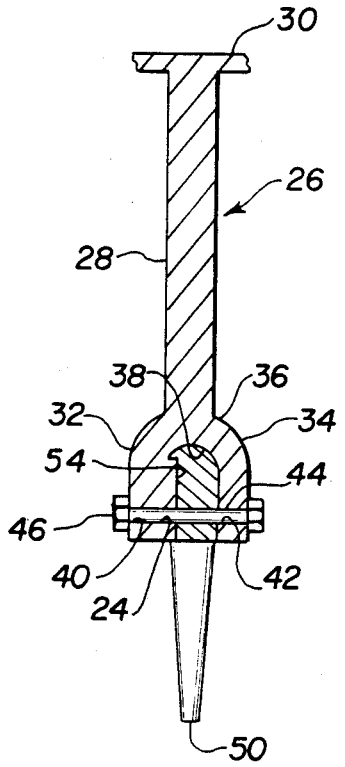
FIG. 2 is a cross-section, generally along the line 2—2 of Fig. 1 of one embodiment of a punch tool apparatus of this invention including connecting means for the anvil member that provides for adjustment in discrete increments of the angular relation between the anvil member and the body of the tool.
Figure 3:
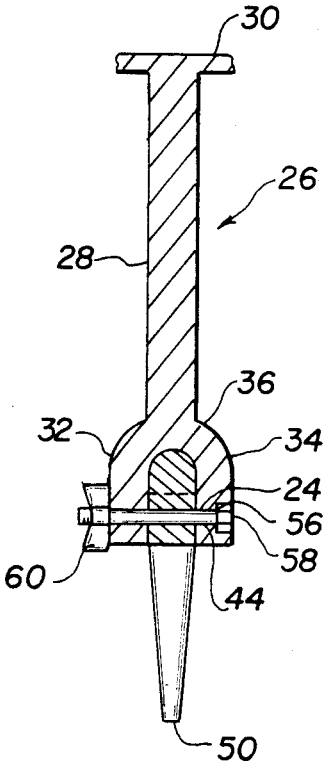
FIG. 3 is a crosssection, generally along the line of 2—2 of Fig. 1 of a punch tool apparatus of this invention in which the means connecting the anvil member to the tool body provide for adjustment of the angle between the anvil member and the tool body to a preselected angle within a continuous angular range.

In one embodiment of the apparatus of this invention, the tool 10 can be constructed with anvil member 26 attached to body 12 as a unitary appendage of body 12 permanently set at a fixed angle, such as 90° with relation to the central longitudinal axis of body 12. However, providing connecting means between anvil member 26 and body 12 that afford a rigid connection in assembled use, while permitting rotation of anvil member 26 about connecting bolt 44 to enable setting anvil member 26 at an angle selected from a wide range of available angles permits greater flexibility and use of the tool. FIGS. 2 and 3 show different preferred embodiments of the apparatus of this invention with relation to the structural means providing for setting the preselected angle of anvil member 26.

As shown in FIGS. 1 and 2, a plurality of radial grooves 52 is formed on one lateral surface of boss 22, with each of the grooves 52 radiating from a common point coincident with the center of hole 24. A ridge 54 is formed on the inner surface 38 of side member 32 of yoke 36 adjacent grooves 52 on boss 22. Ridge 54 and grooves 52 are constructed and arranged to provide for engagement of ridge 54 in one of the grooves 52 when nut 46 is tightened on bolt 44 with the tool assembled for use with anvil member 26 set at a preselected angle. To change the angular relation between anvil member 26 and body 12, bolt 44 and nut 46 are removed, anvil member 26 is removed from boss 22 by sliding anvil member upwardly from boss 22 to disengage ridge 54 from groove 52. Then anvil member 26 can be replaced on the tool by sliding ridge 54 into another selected groove 52 to change the angle between anvil member 26 and body 12. After anvil member 26 is replaced in its selected position, bolt 44 and nut 46 are tightened to provide a rigid assembly in use. In another embodiment of the apparatus of this invention, grooves 52 can be provided on both lateral surfaces of boss 22 and both side members 32 and 34 of anvil 36 can be provided with a ridge 54 adapted to engage with the grooves 52.

FIG. 3 shows another embodiment of the apparatus of this invention wherein the lateral surfaces of boss 22 and the interior surfaces of yoke 36 along side members 32 and 34 are smooth. A recess 56 is formed in the outer surface of side member 34 of yoke 36. Recess 56 is coaxial with bolt 44 and has a peripheral configuration adapted to secure the head 58 of bolt 44. In a preferred construction, the periphery of recess 56 and the head 58 of bolt 54 have matching polygonal shapes to secure bolt 44 and to prevent turning of bolt 44 in use and assembly of tool 10. A wing nut 60 or other suitable fastener, is secured to the end of bolt 44 contiguous to the outer surface of side member 32 of yoke 36. When wing nut 60 is loosened, anvil member 26 can be rotated about boss 22 through a continuous range of angles until a preselected angle is reached. Then wing nut 60 is tightened to provide a rigid connection of anvil member 26 to boss 22 in use.

The materials of construction of tool 10 can vary with the intended use of the tool. If the tool is to be used with sheet metal or heavier gauge metals, body 12 and punch member 20 can be made of steel. If the tool is intended for use on plastic or other similar very light gauge materials, body 12, punch member 20 and anvil member 26 can be made of high impact plastic.

This invention provides a method for disengaging a fastener from an object containing the fastener in a limited work space or in a restricted work area. In certain embodiments of the method of this invention, the head of the fastener can be filed or ground to facilitate easier removal. If desired, a tool constructed according to the apparatus of this invention and having a chisel end member 20 co-axially aligned with body 12, can be used to remove the head of the fastener. When the fastener is to be removed, one inserts into the work place the punch member of a tool having a body with the punch member at one end, grip means connected to the other end of the body, and an anvil member connected to the body between the punch and the grip means. The anvil member of the tool is adjusted to provide easy access to the anvil member for applying force to the tool; the punch is positioned in aligned engagement with the fastener, and force is applied to the anvil member sufficient for the punch to dislodge the fastener from the object or, more specifically, to drive the fastener through the object.

This invention further provides a method for punching a hole in the object at a point located within a limited work space or within a relatively restricted work area. In that method, one selects a tool having a punch member connected to one end of the body, grip means connected to the other end of the body, and an anvil member connected to the body between the punch end and the grip means. For purposes of forming the desired hole, one can select a tool having a punch member, a pick member, a nail member, or other suitable working member. The tool is inserted into the work space and the punch member or other working member is positioned in aligned engagement with the point on the object at which the hole is desired. The anvil member, adjusted to an angle providing easy access to the anvil member, is then struck with force sufficient for the punch to pierce the object and punch a hole in the object at the desired point.

The present invention provides a method and apparatus with which fasteners can be removed, and holes can be formed, in work surfaces that are relatively inaccessible or that are contained within limited work spaces. Use of an adjustable anvil member that can be extended and positioned remote from the work area while remaining readily accessible for the application of force, enables use of the method and apparatus of this invention in a wide range of circumstances and conditions.

According to the provisions of the patent statutes, I have explained the principle, preferred construction, and mode of operation of my invention and have illustrated and described what I now consider to represent its best embodiments. However, it should be understood that, within the scope of the appended claims, the invention may be practiced otherwise than is specifically illustrated and described.

We claim:

1. A method for disengaging a fastener from an object containing said fastener in a limited work space with a tool having a body, grip means connected to one end of said body, a punch member connected to the other end of said body in angular relation to said body and remote from said grip means and an anvil member pivotally connected to said body between said punch member and said grip means, said method comprising pivoting said anvil member to an acute angle relative to said body that permits positioning said punch member of said tool in engagement with said fastener in said limited work space and also permits easy access to said anvil member for applying force to said tool, inserting into said work space said punch member of said tool, positioning said punch member in engagement with said fastener, and striking said anvil member with sufficient force to transmit to said punch member a driving force. directed toward said fastener of sufficient magnitude to drive said fastener through said object.

2. A method for punching a hole in an object at a point located within a limited work space with a tool having a body, grip means connected to one end of said body, a punch member connected to the other end of said body in angular relation to said body and remote from said grip means and an anvil member pivotally connected to said body between said punch member and said grip means, said method comprising pivoting said anvil member to an angle relative to said body that permits positioning said punch member of said tool in engagement with said object at said point within said limited work space and also permits easy access to said anvil member for applying force to said tool, inserting into said work space said punch member of said tool, positioning said punch member in engagement with said object at said point within said work space, and striking said anvil member with sufficient force to transmit to said punch member a driving force directed toward said object of sufficient magnitude to pierce said object and punch said hole at said point.

3. A punch tool for applying to a work piece a driving force directed toward said work piece comprising a body having two opposite end portions, grip means mounted on one of said body end portions, a punch member connected to the other of said body end portions remote from said grip means to apply to said work piece said driving force directed toward said work piece, and an elongated anvil member pivotally connected to said body between said grip means and said punch member, said elongated anvil member extending at an angle away from said pivotal connection, toward said grip means and terminating at a position displaced from said body so that striking said anvil member transmits to said punch member said driving force directed toward said work place.

4. Apparatus as set forth in claim 3 wherein said anvil member is selectively adjustable to one of a range of discrete angular settings within the range of from 20 degrees to 90 degrees, said angle being formed by the intersection of a central, longitudinal axis through said anvil member and a central longitudinal axis through the portion of said body contiguous to said grip means.

5. The apparatus as set forth in claim 3 wherein said body has a transverse hole extending therethrough and located on said body between said grip means and said punch member, and said anvil member comprises an elongated shank having an impact surface at one end thereof remote from said body, and a yoke integral with the other end of said shank contiguos to said body, said yoke comprising a pair of spaced, opposing first and second side members, constructed and arranged to slidably engage said body, a first bore and a second bore, mutually aligned about their central axes, and each extending respectively, through said first side member and said second side member of said yoke, each of said first bore and said second bore arranged in axial alignment with said hole through said body, and releasable fastening means secured in said hole, said first bore and said second bore.

6. The apparatus as set forth in claim 3 wherein said body has an anvil connecting member having spaced opposed side surfaces located on said body between said grip means and said punch member, a transverse hole extends through said body between said side surface of said anvil connecting member, at least one of said side surfaces of said anvil connecting member has formed thereon a plurality of linear grooves extending radially along said side surface from the center line through said hole in said body, and said anvil member comprises an elongated shank having an impact surface at one end thereof remote from said body, and a yoke integral with the other end of said shank contiguous to said body, said yoke comprising a pair of spaced, opposing first and second side members, each having an interior surface contiguous to said anvil connecting member on said body, a first bore and a second bore, mutually aligned along their central axes, and each extending, respectively, through said first side member and said second side member of said yoke, each of said first bore and said second bore arranged in axial alignment with said hole through said body, at least one of said interior surfaces of said first and second side members of said yoke having formed thereon a ridge extending radially from the central as is of one of said first bore and said second bore, said plurality of grooves on said anvil connecting member and said ridge on said yoke side member being constructed and arranged for selected mutual locking engagement, and releasable fastening means secured in said hole, said first bore and said second bore.

7. The apparatus as set forth in claim 3 wherein said anvil member is selectively adjustable to a preselected pivot angle within the continuous range of from 20 degrees to 90 degrees, said angle formed by the intersection of the central longitudinal axis through said anvil member and the central longitudinal axis through the portion of said body contiguous to said grip means.

* * * * *